US012618409B2

(12) United States Patent
Schmidt et al.

(10) Patent No.: US 12,618,409 B2
(45) Date of Patent: May 5, 2026

(54) SUBMERSIBLE PUMP

(71) Applicant: Vortex Pipe Systems LLC, Austin, TX (US)

(72) Inventors: Paul Wayne Schmidt, Carlton, OR (US); Avijit Ghosh, Austin, TX (US)

(73) Assignee: Vortex Pipe Systems LLC, Austin, TX (US)

( * ) Notice: Subject to any disclaimer, the term of this patent is extended or adjusted under 35 U.S.C. 154(b) by 0 days.

(21) Appl. No.: 18/986,014

(22) Filed: Dec. 18, 2024

(65) Prior Publication Data

US 2025/0137457 A1 May 1, 2025

Related U.S. Application Data

(63) Continuation of application No. 18/431,591, filed on Feb. 2, 2024, now Pat. No. 12,221,985, which is a continuation of application No. 18/332,173, filed on Jun. 9, 2023, now Pat. No. 11,953,026.

(51) Int. Cl.

| | |
|---|---|
| ***F04D 3/02*** | (2006.01) |
| ***F04D 13/08*** | (2006.01) |
| ***F04D 29/54*** | (2006.01) |

(52) U.S. Cl.

CPC ..... *F04D 3/02* (2013.01); *F04D 13/08* (2013.01); *F04D 29/548* (2013.01)

(58) Field of Classification Search

CPC ... F04D 3/00; F04D 3/02; F04D 13/08; F04D 19/02; F04D 29/66; F04D 29/669; F04D 29/046; F04D 29/181

See application file for complete search history.

(56) References Cited

U.S. PATENT DOCUMENTS

| | | | | |
|---|---|---|---|---|
| 4,443,152 | A | 4/1984 | Wong et al. | |
| 5,139,391 | A | 8/1992 | Carrouset | |
| 9,527,014 | B1 | 12/2016 | Culler | |
| 9,574,562 | B2 * | 2/2017 | Van Dam | F04D 29/688 |
| 2003/0161739 | A1 | 8/2003 | Chu et al. | |
| 2005/0281683 | A1 * | 12/2005 | Brown | F04D 29/181 417/313 |
| 2017/0306994 | A1 | 10/2017 | Schmidt et al. | |

* cited by examiner

*Primary Examiner* — Nathaniel E Wiehe
*Assistant Examiner* — Jackson N Gillenwaters
(74) *Attorney, Agent, or Firm* — David O. Simmons; IVC Patent Agency

(57) ABSTRACT

A submersible pump comprises a rotational assembly and a rotational assembly housing. The rotational assembly has a plurality of in-line flow inducing sections. A centerline longitudinal axis of each of the flow inducing sections extends colinearly with a rotational axis of the rotational assembly. A downstream end portion of a flow pressurizing section is engaged with an upstream end portion of a rotational flow amplification section. A downstream end portion of the rotational flow amplification section is engaged with an upstream end portion of a flow outlet section. The rotational assembly housing has an interior space extending along a centerline axis of the rotational assembly housing. The rotational assembly is disposed within the interior space of the rotational assembly housing. The rotational assembly and the rotational assembly are jointly configured for causing the rotational axis to extend colinearly with the centerline longitudinal axis of the rotational assembly housing.

25 Claims, 8 Drawing Sheets

SUBMERSIBLE PUMP

CROSS-REFERENCE TO RELATED APPLICATIONS

This patent application claims the benefit of priority as a continuation from co-pending United States Non-provisional patent application having Ser. No. 18/431,591, filed 2 Feb. 2024, which claims the benefit of priority as a continuation from co-pending United States Non-provisional patent application having Ser. No. 18/332,173, filed 9 Jun. 2023, entitled "SUBMERSIBLE PUMP," now issued U.S. Pat. No. 11,953,026, which claims the benefit of priority as a continuation from co-pending United States Non-provisional patent application having Ser. No. 18/149,463, filed 3 Jan. 2023, entitled "SUBMERSIBLE PUMP," now issued U.S. Pat. No. 11,713,764, which claims the benefit of priority from co-pending United States Provisional patent application having Ser. No. 63/388,308, filed 12 Jul. 2022, entitled "SUBMERSIBLE PUMP", all of which having a common applicant herewith and being incorporated herein in their entirety by reference.

FIELD OF THE DISCLOSURE

The disclosures made in this Specification relate generally to flowable material pumps and, more particularly, to submersible pumps for flowable fluid material such as liquid.

BACKGROUND

Electric submersible pumps (ESPs) are flowable material pumps well known in the art. ESPs are typically disposed at the end of a length of a fluid flow conduit (e.g., tubing or pipe) within a well bore that extends generally vertically through a geological formation. Fluid pumping is achieved via a plurality of sequential fluid pressurization stages that are driven (i.e., powered) in a rotary manner by an electric motor. Depending on the specific design of an ESP, the plurality of fluid pressurization stages may include one or more centrifugal disc plates, one or more impellers or the like. The underlying function of the fluid pressurization stages is to pressurize the fluid for causing fluid flow along the axial length of the fluid flow conduit (e.g., which may be vertically extending).

Conventional ESPs are known to exhibit various shortcomings. One such shortcoming is pumping loss resulting from directional changes in the fluid flow as the fluid flows through the various fluid pressurization stages. For example, each change of direction of the fluid flow causes a loss in momentum at an inlet area of the ESP. This loss in momentum results in the need for additional energy to mitigate associated volumetric flow loss. The load generated by this additional energy (i.e., additional operational power for mitigating the associated volumetric flow loss power) can have the effect of accelerating internal pump wear, thereby reducing the overall life of the ESP. Another such shortcoming is the fluid pressurization stages generating turbulent fluid flow that decays into laminar straight line flow, which results in pumping losses arising from increased side wall drag within the fluid flow conduit.

Therefore, an ESP that overcomes shortcomings associated with conventional ESP's would be advantageous, desirable and useful.

SUMMARY OF THE DISCLOSURE

Embodiments of the disclosures made herein are directed to submersible pumps (electric or otherwise) that overcome shortcomings associated with conventional ESP's. To this end, relative to conventional ESPs, submersible pumps in accordance with embodiments of the disclosures made herein beneficially reduce pumping pressure loses, reduce pumping energy, provide enhanced volumetric flow efficiency arising from increased flow velocities and exhibit enhanced longevity of operation. Unlike conventional ESP's that exhibit considerable energy inefficiencies arising from pumping loss caused by directional changes in the fluid flow as the fluid flows through the various fluid pressurization stages (as discussed above), ESP's in accordance with embodiments of the disclosures made herein exhibit a marked reduction in relative energy consumption and increase in flow capacity as a result of the in-line flow to reduce, if not eliminate, detrimental directional changes in the fluid flow and associated frictional flow losses. Additionally, submersible pumps in accordance with embodiments of the disclosures made herein beneficially mitigate, if not eliminate, common cavitation issues exhibited in many centrifugal ESPs and other types of pump designs. These enhanced functionalities result in enhanced performance, reliability and durability.

In one or more embodiments, a submersible pump comprises a rotational assembly and a rotational assembly housing. The rotational assembly has a plurality of in-line flow inducing sections. A centerline longitudinal axis of each of the flow inducing sections extends colinearly with a rotational axis of the rotational assembly. A downstream end portion of a flow pressurizing section is engaged with an upstream end portion of a rotational flow amplification section. A downstream end portion of the rotational flow amplification section is engaged with an upstream end portion of a flow outlet section. The rotational assembly housing has an interior space extending along a centerline longitudinal axis of the rotational assembly housing. The rotational assembly is disposed within the interior space of the rotational assembly housing. The rotational assembly and the rotational assembly housing are jointly configured for causing the rotational axis to extend colinearly with the centerline longitudinal axis of the rotational assembly housing.

In one or more embodiment of the disclosures made herein, a submersible pump comprises a rotational assembly having a rotational axis and a rotational assembly housing having an interior space extending along a centerline axis of the rotational assembly housing. The rotational assembly is disposed within the interior space of the rotational assembly housing with the rotational axis extending colinearly with the centerline longitudinal axis of the rotational assembly housing. The rotational assembly comprises an impeller, a rotational flow amplification body and an outlet body. The impeller has a sidewall that extends around the rotational axis to define an interior space of the impeller. The sidewall tapers such that the impeller has a first cross-sectional area adjacent a first end portion thereof and a second cross-sectional area adjacent a second end portion thereof. The second cross-sectional area is larger than the first cross-sectional area. The sidewall includes a plurality of flow-inducing protrusions each extending outwardly away from the interior space of the impeller and extending from adjacent the first end portion of the impeller with an upward inclination in a direction opposite of a rotational direction of the rotational assembly. Each of the flow-inducing protrusions extends from adjacent the first end portion of the impeller to adjacent the second end portion of the impeller. Each of the flow-inducing protrusions has a leading edge and a trailing edge relative to the rotational direction. Each of the flow-inducing protrusions has a fluid flow passage extending therethrough along at least a portion of the leading edge. The rotational flow amplification body has a first end portion engaged with the second end portion of the impeller in a manner that inhibits unrestricted rotational movement therebetween in at least the rotational direction. The rotational flow amplification body has a central passage extending along its entire length. A centerline axis of the rotational flow amplification body extends colinearly with the rotational axis. A plurality of vanes extend from an interior surface of the rotational flow amplification body that defines its central passage. Each of the vanes extends from adjacent the first end portion of the rotational flow amplification body with an upward inclination in a direction opposite the rotational direction of the rotational assembly. The outlet body has a first end portion thereof engaged with a second end portion of the rotational flow amplification body in a manner that inhibits unrestricted rotational movement therebetween at least in the rotational direction. A centerline axis of the outlet body extends colinearly with the rotational axis.

In one or more embodiments, the rotational flow amplification section includes a plurality of bearings integral with its exterior surface and each of the bearings has a circumferential outer surface that engages a mating portion of an interior surface defining the interior space of the rotational assembly housing.

In one or more embodiments, each of the bearings includes one or more flutes within its circumferential outer surface.

In one or more embodiments, an interior space of the flow pressurizing section extends contiguously to a central passage of the rotational flow amplification section and the central passage of the rotational flow amplification section extends contiguously to a central passage of the flow outlet section.

In one or more embodiments, a closed end portion of the interior space of the flow pressurizing section opposite its downstream end portion has a maximum inside diameter less than a maximum inside diameter of the interior space of the flow pressurizing section at its downstream end portion, the interior space of the flow pressurizing section at its downstream end portion has a maximum inside diameter approximately the same as a maximum inside diameter of the central passage of the rotational flow amplification section, the central passage of the rotational flow amplification section has a maximum inside diameter approximately the same as a maximum inside diameter of the central passage of the flow outlet section at its upstream end portion and the central passage of the flow outlet section has a cross-sectional area along its length that tapers from the maximum inside diameter at its upstream end portion to a smaller inside diameter at its downstream end portion.

In one or more embodiments, the flow pressurizing section includes an impeller having a sidewall that extends around the rotational axis to define an interior space of the impeller, the sidewall tapers such that the impeller has a first cross-sectional area adjacent to its first end portion and a second cross-sectional area adjacent to its second end portion, the second cross-sectional area is larger than the first cross-sectional area, the sidewall includes a plurality of flow-inducing protrusions each extending outwardly away from an interior space of the intake space and extending from adjacent the first end portion of the impeller with an upward inclination in a direction opposite the rotational direction of the rotational assembly, each of the flow-inducing protrusions extends from adjacent the first end portion of the impeller to adjacent the second end portion of the impeller, each of the flow-inducing protrusions has a leading edge and a trailing edge relative to the rotational direction and each of the flow-inducing protrusions has a fluid flow passage extending along at least a portion of its leading edge.

In one or more embodiments, each flow-inducing protrusion has an interior surface that is offset from its exterior surface by an approximately uniform distance such that each flow-inducing protrusion defines a cavity within an interior surface the sidewall.

In one or more embodiments, the fluid flow passage of each of the flow-inducing protrusions extends along only a central portion of the respective one of the flow-inducing protrusions to thereby define a first fluid flow stage between first end portion of the impeller and a first end portion of the fluid flow passage, a second fluid flow stage between the first end portion of the fluid flow passage and its second end portion and a third fluid flow stage between the second end portion of the fluid flow passage and the second end portion of the impeller.

In one or more embodiments, the rotational flow amplification body has a central passage, a plurality of vanes extend from an interior surface of the rotational flow amplification body that defines its central passage and each of the vanes extending from adjacent to the first end portion of the rotational flow amplification body with an upward inclination in a direction opposite to the rotational direction of the rotational assembly.

In one or more embodiments, each of the vanes has a cupped surface on its downstream facing side.

In one or more embodiments, each of the vanes extends contiguously along approximately an entire length of the interior surface of the rotational flow amplification body.

These and other objects, embodiments, advantages and/or distinctions of the present invention will become readily apparent upon further review of the following specification, associated drawings and appended claims.

DETAILED DESCRIPTION

FIGS. 1-8 show an electric submersible pump in accordance with one or more embodiments of the disclosures made herein (i.e., pump 100) that is configured for use with flowable fluid material such as, for example, a liquid. The pump 100 employs a structural arrangement that beneficially reduce pumping pressure loses, reduce pumping energy, provide enhanced volumetric flow efficiency arising from increased flow velocities and mitigate, if not eliminate, common cavitation issues. These enhanced functionalities result in enhanced performance, reliability and durability.

Figure 1:
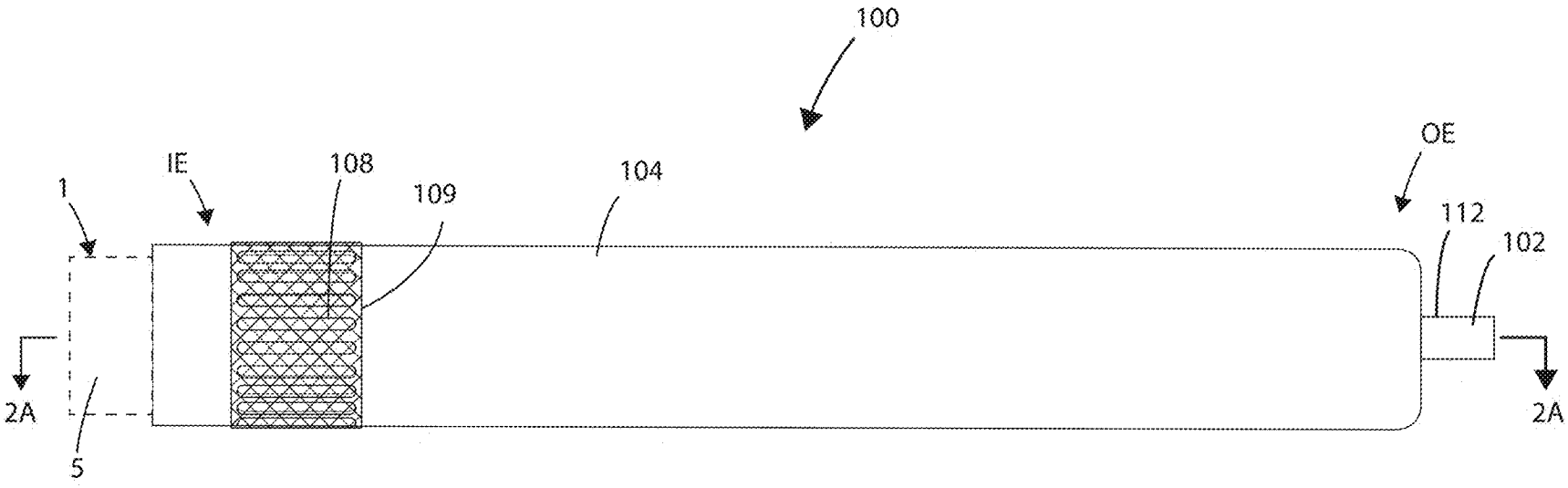
FIG. 1 is a side view showing an electric submersible pump (ESP) in accordance with one or more embodiments of the disclosures made herein.
Figure 2A:
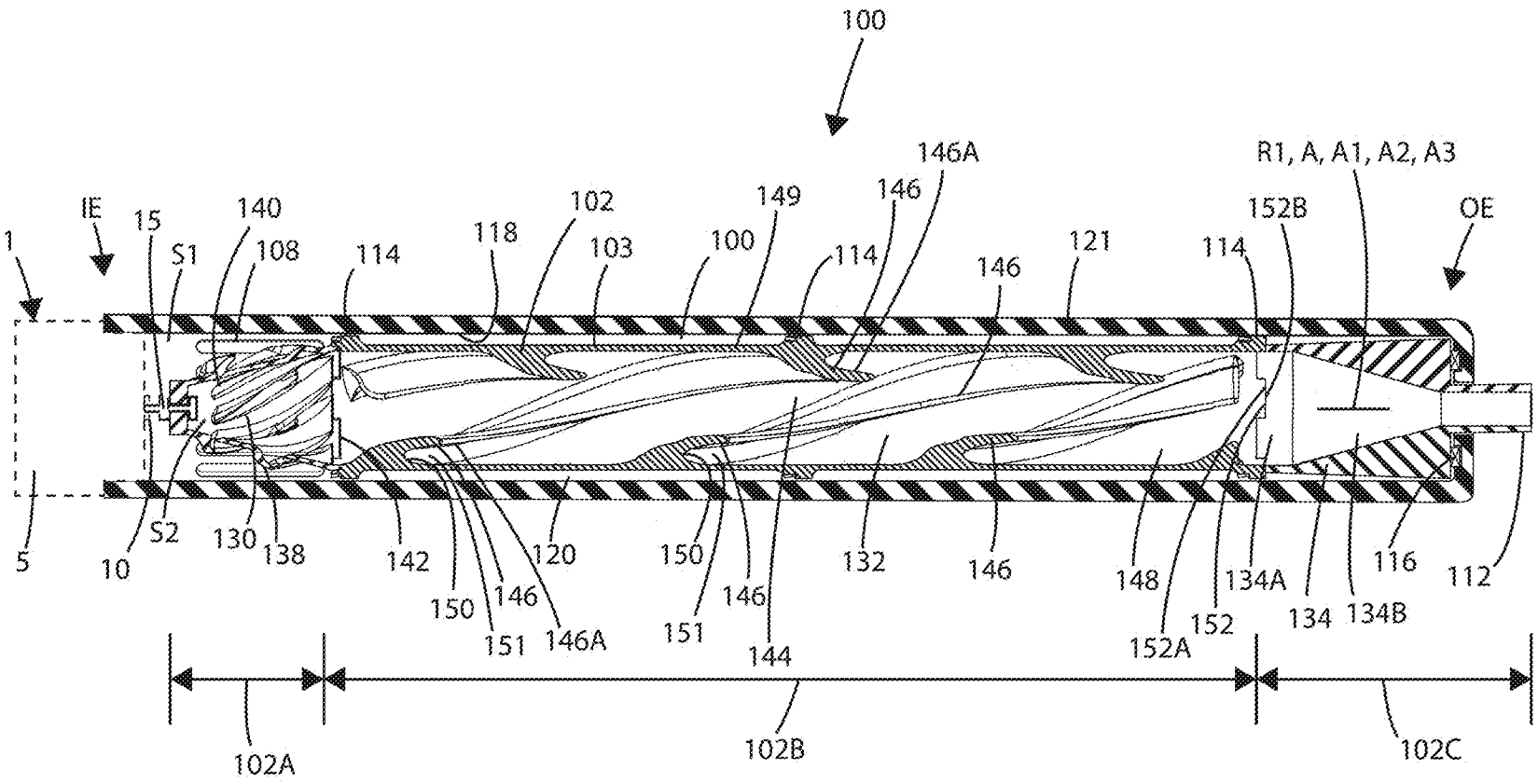
FIG. 2A is a cross-sectional view taken along the line 2A-2A in FIG. 1.
Figure 2B:
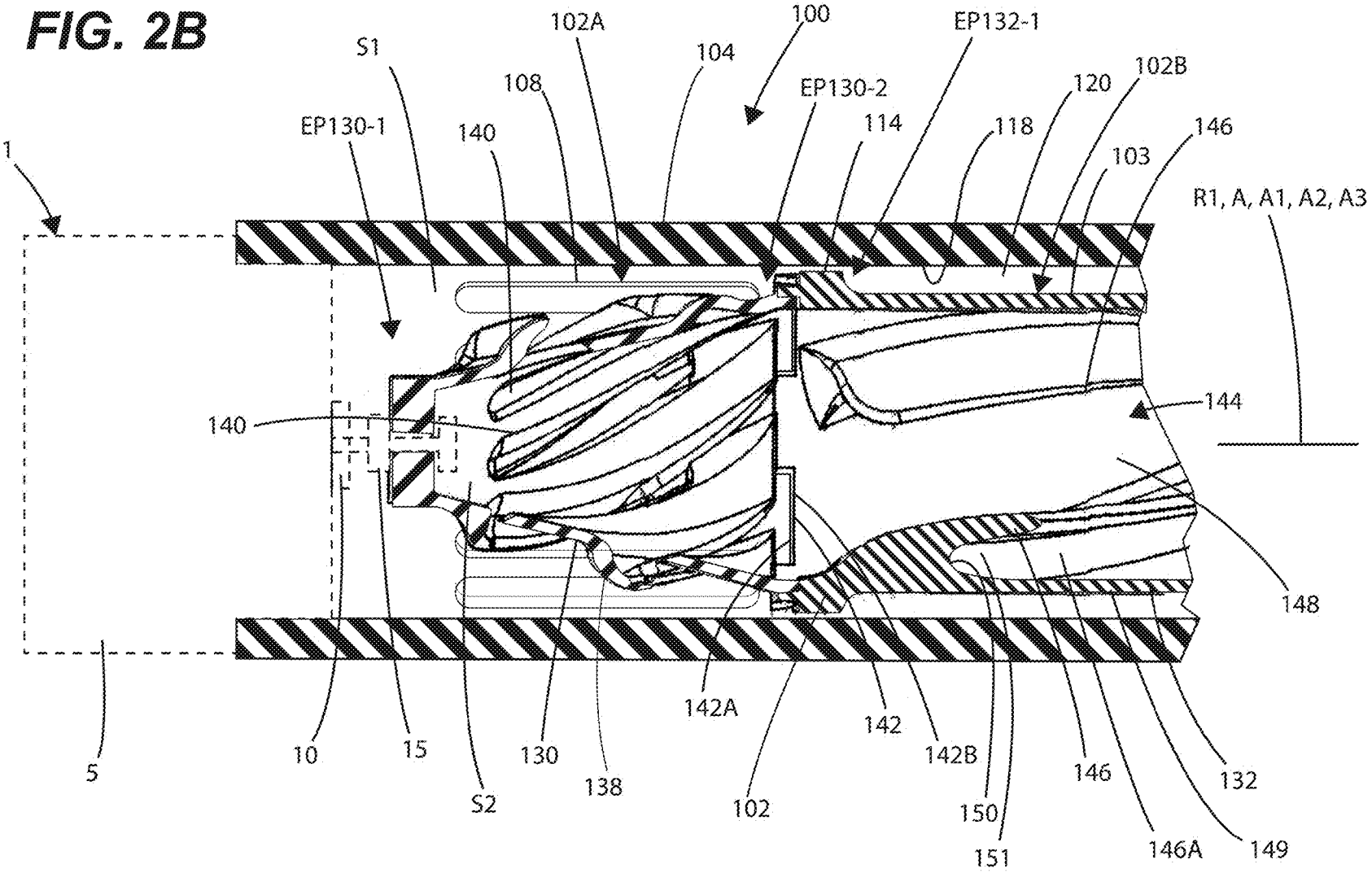
FIG. 2B is an enlarged, fragmentary view taken from FIG. 2A.

As best shown in FIGS. 1, 2A and 2B, the pump 100 comprises a rotational assembly 102 and a rotational assembly housing 104. The rotational assembly housing 104 has an interior space S1 extending along a centerline axis A of the rotational assembly housing 104. The rotational assembly 102 is disposed within the interior space S1 of the rotational assembly housing 104. The rotational assembly 102 has a rotational axis R1 that extends colinearly with the centerline longitudinal axis A of the rotational assembly housing 104.

Figure 2C:
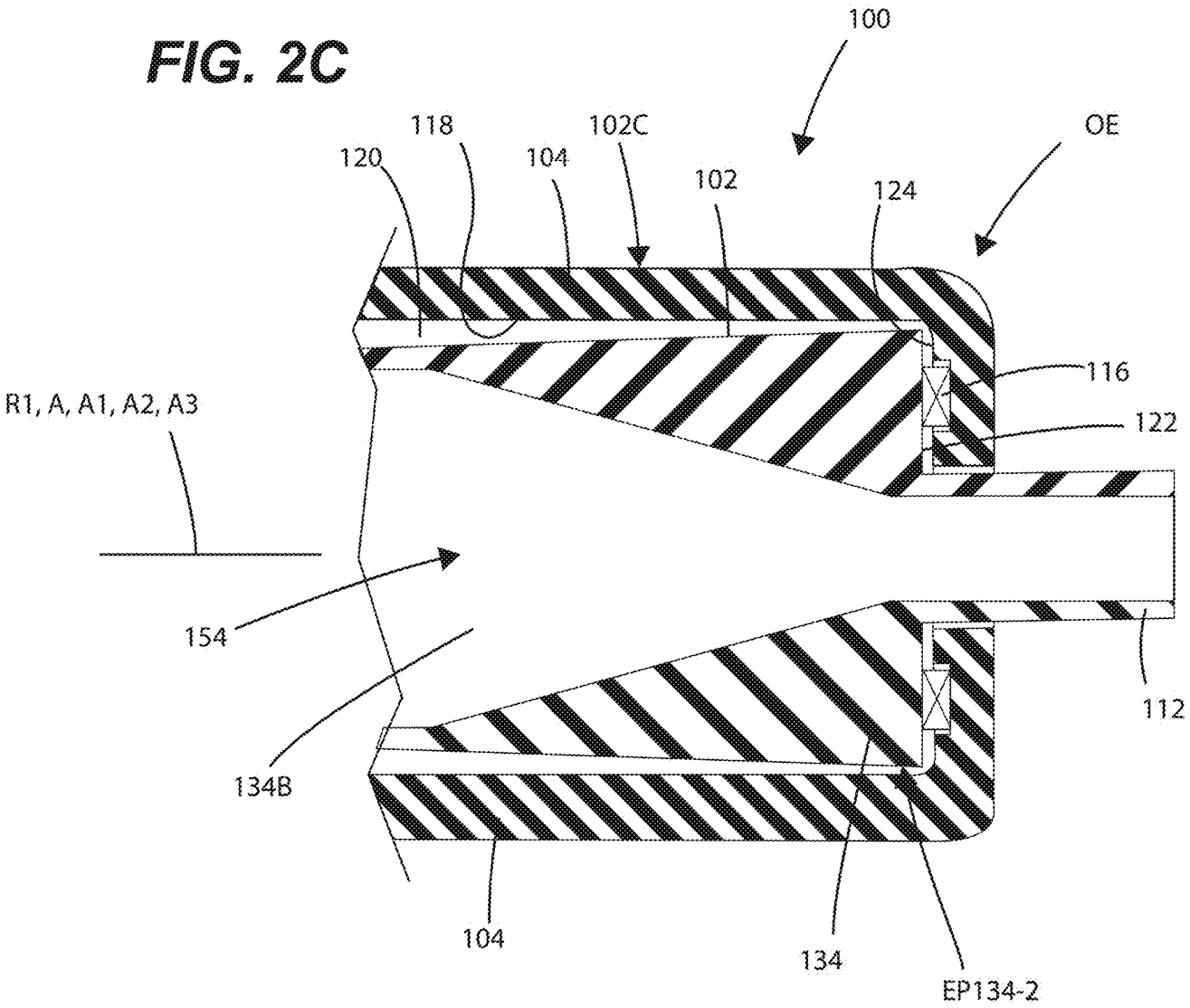
FIG. 2C is an enlarged, fragmentary view taken from FIG. 2A.

As shown in FIGS. 2A-2C, the rotational assembly 102 has a plurality of in-line flow inducing sections: a flow pressurizing section 102A, a rotational flow amplification section 102B and a flow outlet section 102C. A downstream end portion of the flow pressurizing section 102A is engaged with an upstream end portion of the rotational flow amplification section 102B. A downstream end portion of the rotational flow amplification section 102B is engaged with an upstream end portion of the flow outlet section 102C. A centerline longitudinal axis of each of the flow inducing sections (respectively, centerline longitudinal axes A1, A2, A3) extends colinearly with a rotational axis R1 of the rotational assembly 102.

As discussed below in greater detail, rotation of the rotational assembly 102 relative to the rotational assembly housing 104 causes fluid present outside an input end IE of the submersible pump 100 to be drawn into the interior space S1 of the rotational assembly housing 104 through inlet ports 108 within the rotational assembly housing 104. Filter body 109 may be provided over the inlet ports 108 to limit entry of debris. The rotation further causes fluid drawn into the interior space S1 of the rotational assembly housing 104 to be drawn into and pressurized within an interior space S2 of the flow pressurizing section 102A. The pressurized fluid is urged through the rotational flow amplification section 102B for having rotational flow about the rotational axis R1 imparted thereon. Thereafter, the rotational fluid flow is focalized' by the flow outlet section 102C before being outputted via an outlet port 112 of the flow outlet section 102C at an outlet end OE of the rotational assembly housing 104. The rotation also causes fluid through the interior space S1 of the rotational assembly housing 104 between the rotational assembly 102 and inner surface of the rotational assembly housing 104 for providing cooling and lubrication to points of contact between the rotational assembly 102 and the rotational assembly housing 104.

The submersible pump 100 may include a motor 1 for causing rotation of the rotational assembly 102 relative to the rotational assembly housing 104. The motor 1 may be connected to the rotational assembly 102 and the rotational assembly housing 104 by any suitable means that enables rotation of the rotational assembly 102 relative to the rotational assembly housing 104. For example, a main body 5 (e.g., a housing or casing) of the motor 1 may be attached to the rotational assembly housing 104 and a rotational power output portion 10 of the motor 1 may be attached to the rotational assembly 102 for enabling rotational power generated by the motor 1 to be imparted upon the rotational assembly 102. The motor 1 may be attached to the rotational assembly 102 via a coupler 105 that has a first portion engaged with the motor 1 and a second portion engaged with the rotational assembly 102 and that inhibits relative rotational movement therebetween.

In one or more preferred embodiments, the motor 1, the rotational assembly 102 and the rotational assembly housing 104 are jointly configured for maintaining the rotational assembly 102 in compressive engagement with the rotational assembly housing 104. Such compressive engagement serves at least two purposes. The first purpose is such that the rotational assembly 102 rotates in a controlled manner about the rotational axis R1 at one or more rotational speeds. To this end, attachment of the motor 1 to the rotational assembly housing 104 may serve to radially constrain the adjacent end portion of the rotational assembly 102 to rotates in the controlled manner about the rotational axis R1. Optionally or additionally, a support body (e.g., a bracket) may be located between the motor and the rotational assembly 102 for providing or augmenting such radial constraining of the adjacent end portion of the rotational assembly 102. The second purpose is such that, during such rotation of the rotational assembly 102, uncontrolled axial movement of the rotational assembly 102 relative to the rotational assembly housing 104 along the centerline axis A of the rotational assembly housing 104 is controlled (e.g., inhibited).

In support of the aforementioned rotational considerations, as best shown in FIG. 2A-2C, the submersible pump 100 preferably includes a plurality of journal bearings 114 and one or more thrust bearings 116. The journal bearings 114 are axially spaced-apart from each other and are disposed between an outer surface 103 of the rotational assembly 102 and an interior (i.e., central passage defining) surface 118 of the rotational assembly housing 104. The journal bearings 114 and the rotational assembly 102 and inner surface 118 of the rotational assembly housing 104 of the central passage 120 are jointly configured for radially constraining the rotational assembly 102 relative to the inner surface 118 of the rotational assembly housing 104—i.e., for providing rotation of the rotational assembly 102 in a controlled manner about the rotational axis R1. In preferred embodiments, the journal bearings 114 are integral with the exterior surface 103 of the rotational assembly 102 that defines its outer surface 103 and each engage a mating portion of the interior surface 118 of the rotational assembly housing 104.

As best shown in 7, each of the journal bearings 114 may include one or more flutes 115. Each flute 115 extends across an entire width of the respective one of the journal bearings 114. In preferred embodiments, rotation of the rotational assembly 102 results in the flow pressurizing section 102A causing a portion of fluid drawn into the interior space S1 of the rotational assembly housing 104 being urged along the central passage 120 of the rotational assembly housing 104 between the rotational assembly 102 and the interior surface 118 of the rotational assembly housing 104. Each flute 115 serves as a flow-through passage for readily allowing fluid flow across each of the journal bearings 114. Beneficially, fluid flow between the rotational assembly 102 and the interior surface 118 of the rotational assembly housing 104 serves to both cool and lubricate points of contact between the journal bearings 114 and mating portions of the rotational assembly housing 104.

The one or more thrust bearings 116 are located between an end face 122 of the rotational assembly 102 and an interior end face 124 of the rotational assembly housing 104 at the outlet end OE of the submersible pump 100. The end face 122 of the rotational assembly 102, the interior end face 124 of the rotational assembly housing 104 and the one or more thrust bearings 116 (in combination with an implemented means for forcibly biasing the rotational assembly 102 in the downstream direction) are jointly configured for axially constraining the rotational assembly 102 relative to the rotational assembly housing 104 while enabling uniform and controlled rotational movement about the rotational axis R1. In preferred embodiments, a cylindrical roller thrust bearing is utilized between the end face 122 of the rotational assembly 102 and the interior end face 124 of the rotational assembly housing 104 for axially constraining the rotational assembly 102 relative to the rotational assembly housing 104.

In regard to the implemented means for forcibly biasing the rotational assembly 102 in the downstream direction, the rotational assembly 102 may be biased toward the outlet end OE of the submersible pump 100 for causing a compressive force at the interface between the one or more thrust bearings 116, the rotational assembly 102 and the rotational assembly housing 104. In one example, the motor 1 may be in direct (e.g., fixed) engagement with the rotational assembly 102 to forcibly biases the rotational assembly 102 toward the enclosed end face 124 of the rotational assembly housing 104 (i.e., in the downstream direction). In another example, a resilient biasing member (e.g., one or more compression springs such as disc spring washers) are used to apply a balanced torque) may reside between the motor 1 and the rotational assembly 102 to forcibly biases the rotational assembly 102 toward the enclosed end face 124 of the rotational assembly housing 104.

In one or more embodiments, forcibly biasing the rotational assembly 102 in the downstream direction for causing a compressive force at the interface between the one or more thrust bearings 116, the rotational assembly 102 and the rotational assembly housing 104 may be accomplished utilizing a motor mount that interlockedly engages the rotational assembly housing 104 for urging the motor 1 toward the downstream end portion of the rotational assembly housing 104 into compressed engagement with the one or more thrust bearings 116. The interlocking arrangement of the motor mount and rotational assembly housing 104 secures the motor mount to the rotational assembly housing 104 and biases the rotational assembly 102 against the one or more thrust bearings 116. For example, the motor mount may include a body having a threaded portion that engages a mating threaded portion of the rotational assembly housing 104 through which an axial compressive (i.e., preload) force may be exerted at the interface between the one or more thrust bearings 116, the rotational assembly 102 and the rotational assembly housing 104. The motor mount may include a resilient member (e.g., compression spring) that exerts a compressive force on the motor 1 in response to the motor mount being interlockedly engaged with the rotational assembly housing 104.

Figure 3:
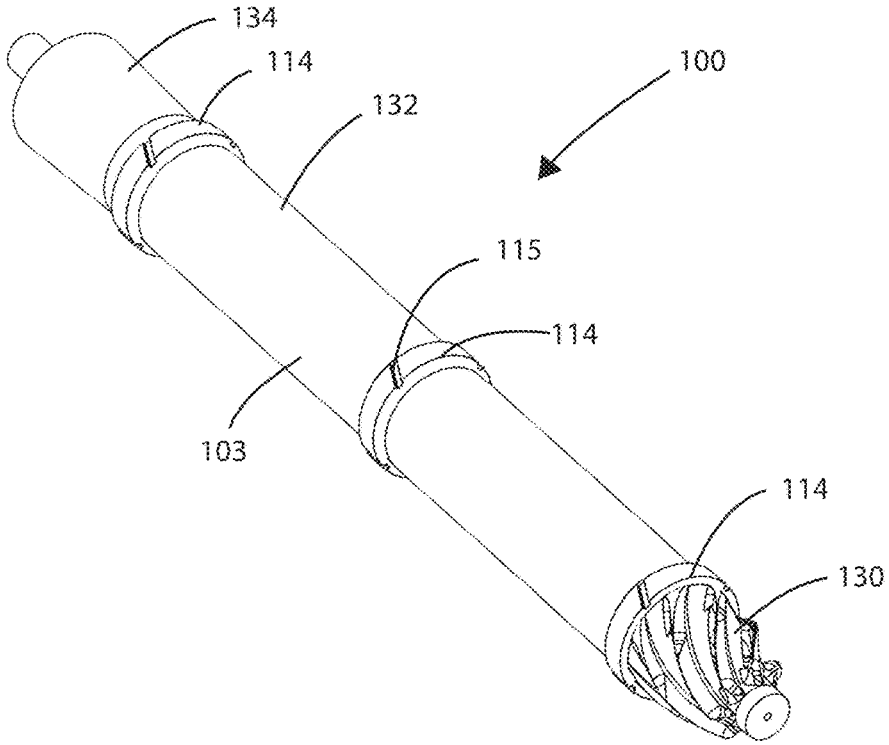
FIG. 3 is a first perspective view showing a rotational assembly of the ESP shown in FIG. 1.
Figure 4:
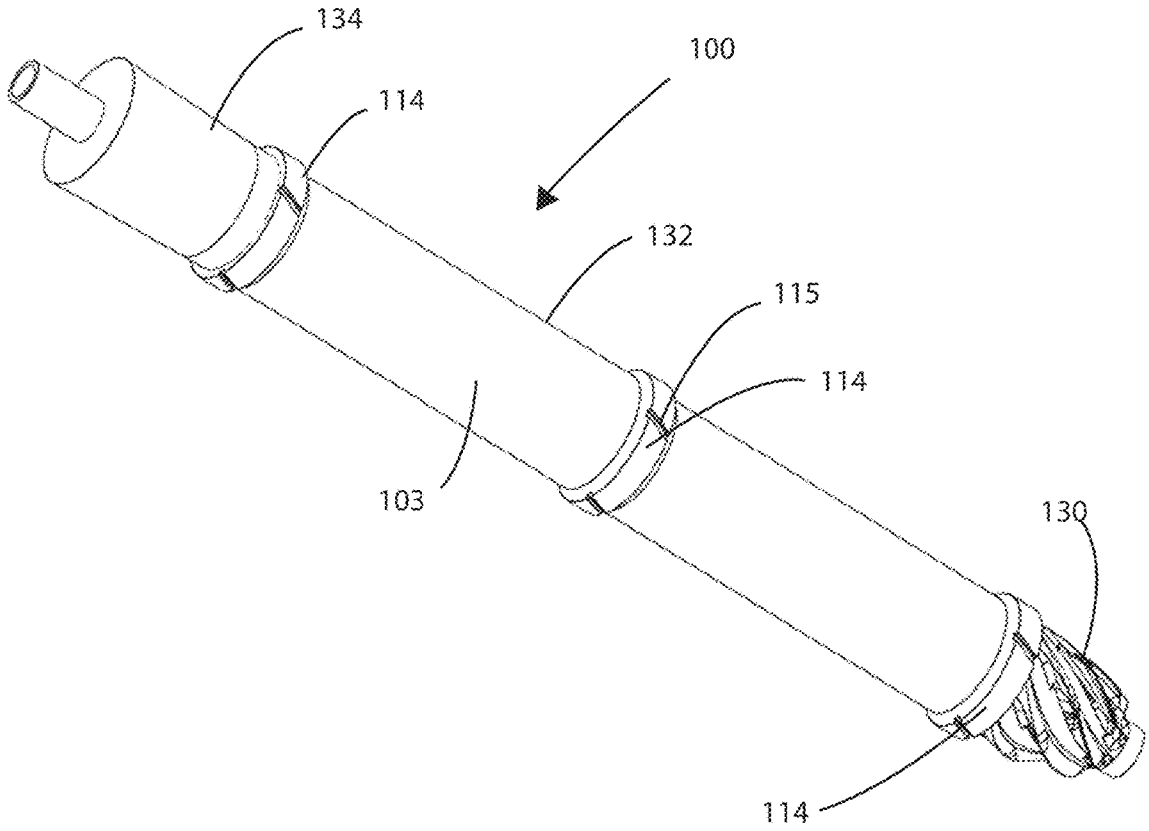
FIG. 4 is a second perspective view showing the rotational assembly of the ESP shown in FIG. 1.

As best seen in FIGS. 2A, 3 and 4, the rotational assembly 102 comprises an impeller 130, a rotational flow amplification body 132 and an outlet body 134. As discussed above, the rotational assembly 102 has a plurality of in-line flow inducing sections: the flow pressurizing section 102A, the rotational flow amplification section 102B and the flow outlet section 102C. The impeller 130 is an embodiment of the flow pressurizing section 102A. The rotational flow amplification body 132 is an embodiment of the rotational flow amplification section 102B. The outlet body 134 is an embodiment of the flow outlet section 102C.

The impeller 130 has a sidewall 136 that extends around the rotational axis R1 to define an interior space S2 of the impeller. The sidewall 136 tapers such that the impeller 130 has a first cross-sectional area adjacent a first end portion EP130-1 and a second cross-sectional area adjacent a second end portion EP130-2. The second cross-sectional area is larger than the first cross-sectional area. In preferred embodiments, the impeller 130 is in the form of an inverted frustum pyramid. A centerline longitudinal axis A1 of the impeller 130 extends colinearly with the rotational axis R1.

The sidewall 136 includes a plurality of flow-inducing protrusions 138 each extending outwardly away from the interior space S2 of the impeller 130. Each of the flow-inducing protrusions 138 extends from adjacent the first end portion EP130-1 of the impeller 130 to adjacent the second end portion EP130-2 of the impeller 130. Each of the flow-inducing protrusions 138 has a leading edge LE and a trailing edge TE relative to a rotational direction RD. Each of the flow-inducing protrusions 138 has a fluid flow passage 140 extending therethrough along at least a portion of the leading edge LE.

In one or more embodiments, the inlet ports 108 may be inclined to have the same or similar inclination as the protrusions 138 of the impeller 130. In one or more embodiments, the inlet ports 108 may include protrusions at the inner surface of the rotational assembly housing 104 that have the same or similar profile as the protrusions 138 of the impeller 130. Preferably, the inlet port protrusions of the rotational assembly housing 104 extend inward from the outer wall of the rotational assembly housing 104. Such inlet port inclination and inlet port protrusion arrangement beneficially impact fluid flow from through the inlet ports and into the interior space S of the impeller 130.

Each of the flow-inducing protrusions 138 extends from adjacent the first end portion EP130-1 of the impeller 130 with an upward inclination in the direction opposite a rotational direction RD of the rotational assembly 102. The term upward inclination is disclosed herein to include at least a portion of the flow-inducing protrusions extending in a non-parallel direction relative to a reference axis that extends radially from the rotational axis R1—i.e., the leading edge LE is facing upstream. For example, the flow-inducing protrusions 138 may have a straight longitudinal axis that is skewed with respect to the rotational axis or may have a longitudinal axis that is at least partially curved such that at least a portion of the longitudinal axis is skewed with respect to the rotational axis.

Figure 5:
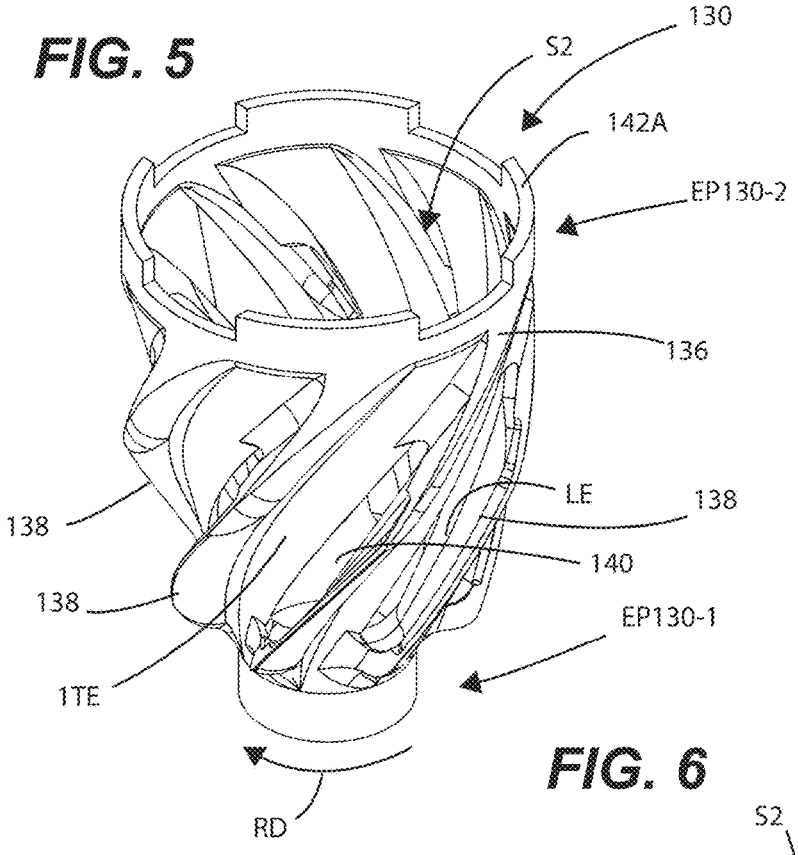
FIG. 5 is a first perspective view showing an impeller of the ESP shown in FIG. 1.
Figure 6:
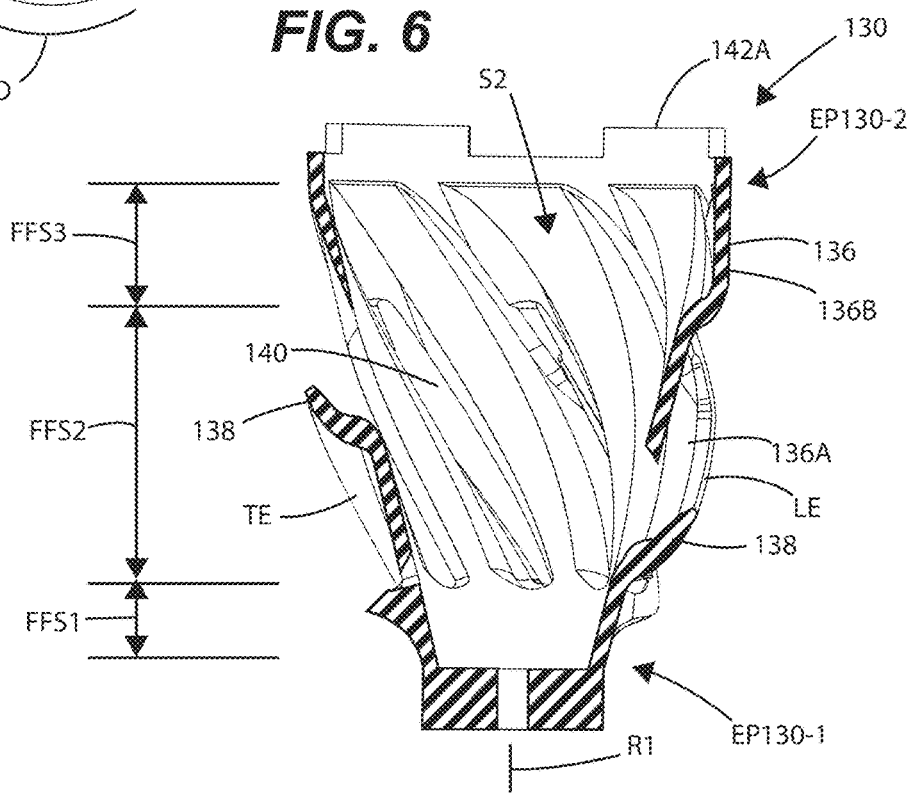
FIG. 6 is a second perspective view showing an impeller of the ESP shown in FIG. 1.
Figure 7:
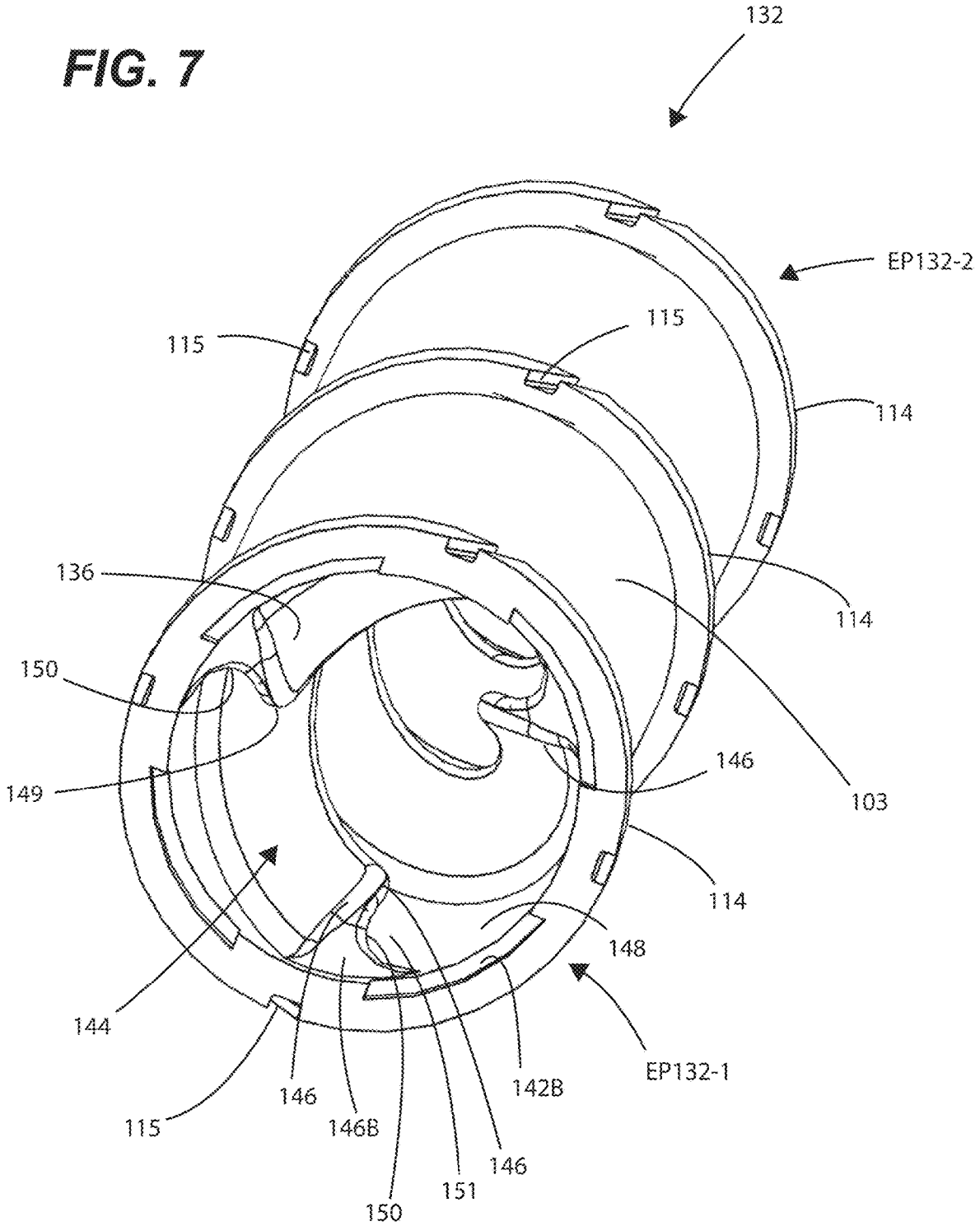
FIG. 7 is a perspective view showing a rotational flow amplification body of the ESP shown in FIG. 1 from an inlet end thereof with counter-clockwise rotation.

Preferably, as best shown in FIGS. 5 and 6, each flow-inducing protrusion 138 has an interior surface 136A and an exterior surface 136B—i.e., opposing surfaces of the sidewall 136. The interior surface 136 A is offset from the exterior surface 136Bby an approximately uniform distance (e.g., the thickness of the sidewall 136) such that each flow-inducing protrusion 138 defines a louver-like body outwardly protruding from the exterior surface of the impeller 130 and forming a respective cavity within the interior surface of the impeller 130. Preferably, as best shown in FIG. 6, the fluid flow passage 140 of each of the flow-inducing protrusions 138 extends along only a central portion of the respective one of the flow-inducing protrusions. In this manner, a first fluid flow stage FFS1 of each flow-inducing protrusion 138 is defined between a first end portion EP130-1 of the impeller 130 and a lower (i.e., first) end portion of the fluid flow passage 140, a second fluid flow stage FFS2 is defined between the lower end portion of the fluid flow passage 140 and a second (i.e., upper) end portion of the fluid flow passage 140 and a third fluid flow stage FFS3 is defined between the upper end portion of the fluid flow passage 140 and the second end portion EP130-2 of the impeller 130. The first fluid flow stage FFS1 is the lowest area on the impeller 130, has the smallest diameter, has the least angle cut and the lower corner may be boxed or otherwise closed.

The rotational flow amplification body 132 has a first end portion EP132-1 engaged with the second end portion EP130-2 of the impeller 130 in a manner that inhibits unrestricted rotational movement therebetween. In preferred embodiments, such engagement includes a first interlocking interface 142 such as in the form of interlocking shoulders 142A, 142B. The interlocking shoulder 142A, 142B may have trapezoidal profiles such that the application of torque causes the interface to draw itself into an interlocking configuration—i.e., in view of the mating tapered edge faces of the trapezoidal profiles. Beneficially, interlocking shoulders having trapezoidal profiles provide a positive locking interface that resists section decoupling resulting from vibration within the pump 100 during operation (i.e., rotational torque application). For certain applications, a rotational flow amplification body in accordance with the disclosures made herein can be configured for being stackable (e.g., via end-to-end mating of opposing interlocking interfaces) such as for increasing the downhole depth pumping capability.

The rotational flow amplification body 132 has a central passage 144. Preferably, the central passage 144 of the rotational flow amplification body 132 is round and has a uniform maximum diameter. Preferably, a centerline axis A2 of the rotational flow amplification body 132 extends colinearly with the rotational axis R1 and the central passage 144 of the rotational flow amplification body 132 extends contiguously with the interior space S1 of the impeller 130. A plurality of vanes 146 (e.g., spiral such as a tapered semi-helix) extend from an interior surface 148 of an exterior wall 149 that defines the central passage 144 of the rotational flow amplification body 132. Each of the vanes 146 extends from adjacent the first end portion of the rotational flow amplification body with an upward inclination in a direction opposite the rotational direction RD. Each of the vanes 146 may extends contiguously along approximately an entire length of the interior surface 148 of the rotational flow amplification body 132. Each vane 146 is preferably equal in total length and have the same profile.

Preferably, as shown in FIGS. 2A and 2B, a downstream facing surface 146A of each vane 146 and the interior surface 148 of the rotational flow amplification body 132 jointly form a cupped surface 150. The cupped surface 150 may extend along all or a portion of a total length of each of the vanes 146. The cupped surface 150 forms an elongated containment space 151 in which a portion of the fluid within the central passage 144 becomes entrapped (at least temporarily) during rotation of the rotational assembly 102. Beneficially, this entrapment of fluid results in a greater amount of energy being applied to the entrapped fluid by the rotational flow amplification body 132 as compared to vanes that do not form a cupped surface and resulting containment space. The greater amount of energy arises from both an increased magnitude of force imparted onto entrapped fluid by virtue of the cupped surface 150 and the duration of time that such entrapped fluid remains within the containment space 151. In one or more embodiments, the cupped surface 150 and containment space 151 may be configured in accordance with a Pelton cup shaped blade.

Figure 8:
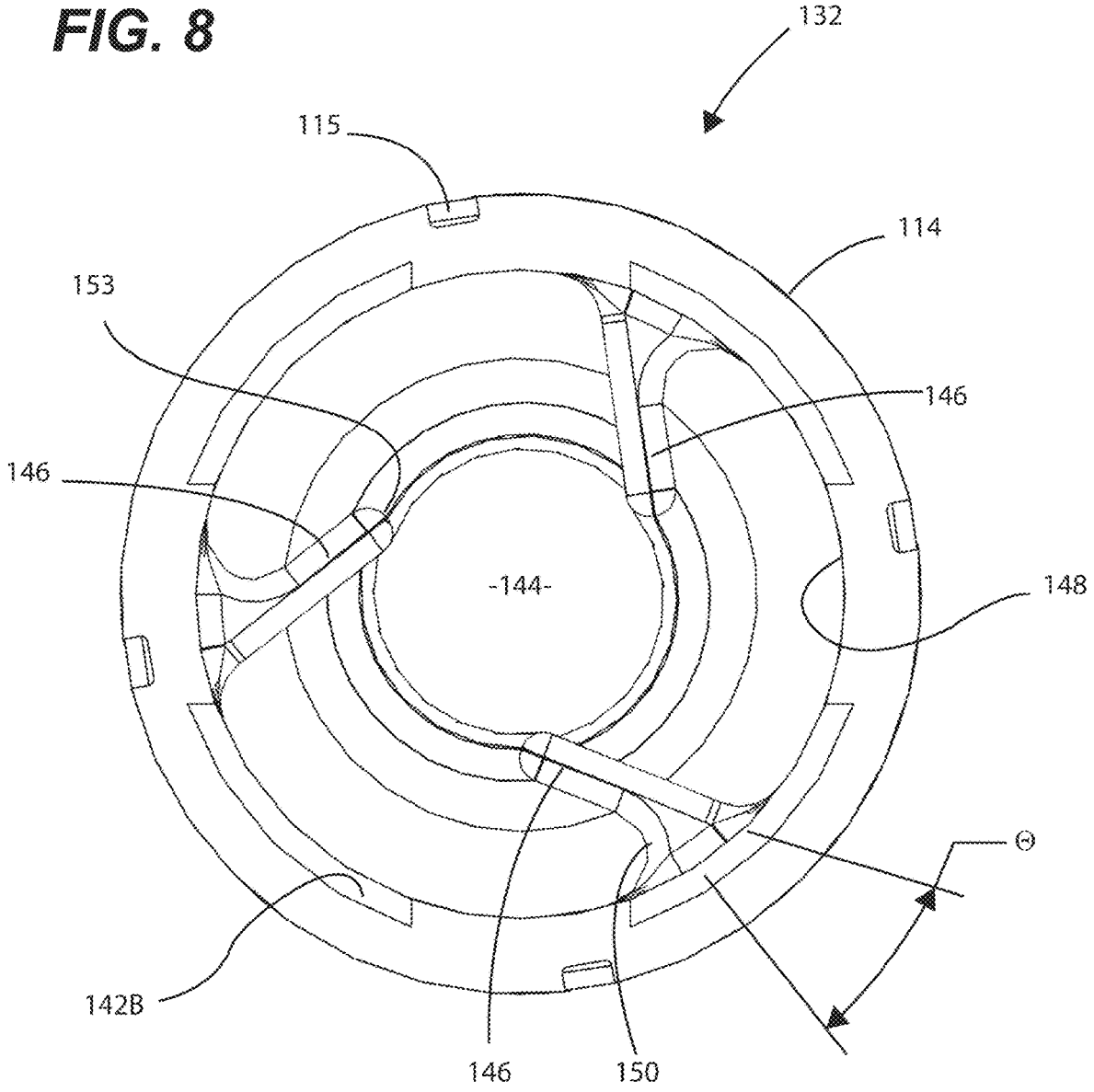
FIG. 8 is an upstream end view of the rotational flow amplification body shown in FIG. 7 from an outlet end thereof with counter-clockwise rotation at the inlet end thereof.

As best shown in FIG. 8, each vane 146 may be inclined at an angle θ (e.g., 45-degrees or more relative to a radial reference line). In addition to the functionality of rotational flow amplification, such an inclination serves to aid in creating a strong axial load during rotation of the rotational assembly 102. The width and angle of the vanes 146 may be such that the inboard edge 153 of each vane 146 is spaced away from each other vane 146 whereby the center area of the rotational flow amplification body 132 is open (i.e., unobstructed). This open center area is where the fluid flowing through the rotational flow amplification body 132 merges and allows any suspended particles to freely pass without causing blockage. At the second end portion EP132-2 of the rotational flow amplification body 132, each vane 146 may have a radius where each vane 146 terminates to allow for a broader flow and to aid in rotational flow of the fluid as it flows into the outlet body 132.

As best shown in FIGS. 2A and 2C, the outlet body 132 has a first end portion EP134-1 engaged with the second end portion EP132-2 of the rotational flow amplification body 132 in a manner that inhibits unrestricted rotational movement therebetween. In preferred embodiments, such engagement includes a first interlocking interface 152 such as in the form of interlocking shoulders 152A, 152B. The interlocking shoulder 152A, 152B may have trapezoidal profiles such that the application of torque causes the interface to draw itself into an interlocking configuration—i.e., in view of the mating tapered edge faces of the trapezoidal profiles.

The outlet body 134 has a central passage 154 that terminates at the outlet port 112 (i.e., the fluid outlet of the pump 100). Preferably, a centerline axis A3 of the outlet body 134 extends colinearly with the rotational axis R1 and the central passage 154 of the outlet body 134 extends contiguously with the central passage 144 of the rotational flow amplification body 132. The central passage 154 of the outlet body 134 preferably has a uniform diameter portion 154A and a convergent portion 154B downstream of the uniform diameter portion 154A. The uniform diameter portion 154A is a flow gate 156 leading into the convergent portion 154B. In preferred embodiments, the convergent portion 154B has a convergent taper of 3:1 over its length relative to inside diameter of the central passage 144 of the rotational flow amplification body 132. The convergent portion 154B may have a straight-tapered inside wall surface (as shown) or a non-linear inside wall surface, as desired. The flow gate 156 may be preceded by a similarly uniform diameter portion of the rotational flow amplification body 132 downstream of the terminal end of the vanes 146.

Turning now to operation of the pump 100, the motor 1 serves to rotate the rotation assembly 102 relative to the rotation assembly housing 104. With at least the inlet end IE of the pump 100 positioned within a fluid (e.g., water) source, this rotation results in uptake, pressurization, rotational flow conversion and output of the fluid from the pump. In contrast of convention ESP's, operation of the pump 100 (i.e., a pump in accordance with one or more embodiments of the disclosures made herein) advantageously provides for enhanced operational functionalities that result in enhanced performance, reliability and durability. These enhanced operational functionalities arise from structural arrangement of the pump 100 that beneficially reduce pumping pressure loses, reduce pumping energy and provide enhanced volumetric flow efficiency arising from increased flow velocities.

Advantageously, rotation of the rotational assembly 102 generates a total dynamic head (TDH) which increases with net positive suction head (NPSH) formed at the fluid inlet of the impeller 130. NPSH is a measure of the pressure experienced by a fluid on the suction side of a pump. Thus, for the pump 100, the NPSH combined with the siphoning jointly contribute to the acceleration of fluid into the rotational flow amplification body 132.

Rotation of the impeller 130 (i.e., a flow pressurizing section of the rotation assembly 102) results in uptake and pressurization of fluid within which at least the inlet end of the pump 100 is located. As discussed above in reference to FIG. 6, the fluid flow passage 140 of each of the flow-inducing protrusions 138 extends along only a central portion of the respective one of the flow-inducing protrusions such that the impeller 130 preferably includes a first fluid flow stage FFS1 (i.e., portion of the impeller below lower edge of fluid flow passage 140), a second fluid flow stage FFS2 (i.e., portion of the impeller extending vertically along length of the fluid flow passage 140) and a third fluid flow stage FFS3 (i.e., portion of the impeller above top edge of fluid flow passage 140). In this respect, each of the flow-inducing protrusions 138 has three different functions. The first fluid flow stage FFS1 creates a siphoning action that promotes flow of fluid from outside the impeller 130 into the interior space S2 of the second fluid flow stage FFS2. In combination with the siphoning action of the first fluid flow stage FFS1, the second fluid flow stage FFS2 draws fluid into the interior space S2 of the second fluid flow stage FFS2 and compresses the fluid. The inside profile of the impeller 130 at the second and third fluid flow stages FFS2, FFS3 pulls the fluid toward the rotational axis R1, begins to impart a rotational flow profile onto the fluid and pressurizes the fluid relative to its inlet pressure. In this respect, after being subjected to the impeller 130, the fluid is provided into the rotational flow amplification body 132 (i.e., a rotational flow amplification section of the rotation assembly 102) in a pressurized manner exhibiting at least a partial rotational flow profile (i.e., in contrast to a random or laminar flow profile).

Rotation of the rotational flow amplification body 132 (i.e., a rotational flow amplification section of the rotation assembly 102) results in the continued transformation of fluid to rotational flow and any associated increase in pressurization. To this end, the rotational flow amplification body 132 creates fluid rotational (e.g., 360-degree fluid rotation) over the total length of the rotational flow amplification body 132. Each vane 146 and the exterior wall 149 jointly define a respective open-faced flow chamber through which portions of the fluid travel to thereby amplify the rotational flow of the fluid initially generated in the impeller 130. The upstream end face of each vane 146 may be spaced away from the impeller 130 to aid in uniform mixing of the fluid as it flows into the enters the rotational flow amplification body 132.

The outlet body 134 (i.e., a flow outlet section of the rotation assembly 102) is the third and final stage of the pump 100. The function of the outlet body 134 is to merge rotational fluid flow streams exiting the rotational flow amplification body 132—i.e., fluid flows from the open-faced flow chambers and open center area of the rotational flow amplification body 132. The taper over the lineal length of the convergent portion 134B of the outlet body 134 creates a compression strength within the rotational fluid flow stream. Kinetic energy is accumulated within this lineal length in both its uniform profile and strength. As fluid exits the outlet body 134, its rotational flow profile is defined and a focal point of the kinetic energy in the output fluid flow is created. The longevity and flow distance of the focal point is defined and controlled by parameters such as, for example, rotational speed, fluid viscosity, transfer pipe diameter/length, and the like.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, wherein the inlet of the flow amplification body is at an upstream end portion of the flow amplification body, wherein the outlet of the impeller is at a downstream end portion of the impeller, and wherein the flow amplification body is directly attached to the impeller.

2. The pump of claim 1 wherein at least one of:

the at least one flow amplifying vane has a cupped surface on a downstream facing side thereof, and the at least one flow-inducing protrusion extends outwardly away from the interior space of the impeller and extends from adjacent a first end portion of the impeller.

3. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, wherein the at least one flow-inducing protrusion has a leading edge and a trailing edge, and wherein the fluid flow passage of the at least one flow-inducing protrusion extends therethrough at the leading edge thereof.

4. The pump of claim 3 wherein a length of the fluid flow passage is less than a length of the leading edge.

5. The pump of claim 3 wherein at least one of:

the at least one flow amplifying vane has a cupped surface on a downstream facing side thereof; and the at least one flow-inducing protrusion extends outwardly away from the interior space of the impeller and extends from adjacent a first end portion of the impeller.

6. The pump of claim 3 wherein:

a closed end portion of the interior space of the impeller opposite the downstream end portion thereof has a maximum inside diameter less than a maximum inside diameter of the interior space of the impeller at the downstream end portion thereof, and the interior space of the impeller at the downstream end portion thereof has a maximum inside diameter the same as a maximum inside diameter of the central passage of the flow amplification body.

7. The pump of claim 6 wherein the at least one flow amplifying vane has a cupped surface on a downstream facing side thereof.

8. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, and wherein the interior space of the impeller is exposed to the central passage of the flow amplification body at the inlet of the flow amplification body.

9. The pump of claim 8 wherein at least one of:

the at least one flow amplifying vane has a cupped surface on a downstream facing side thereof; and the at least one flow-inducing protrusion extends outwardly away from the interior space of the impeller and extends from adjacent a first end portion of the impeller.

10. The pump of claim 8 wherein the at least one flow-inducing protrusion extends from adjacent a first end portion of the impeller to adjacent a second end portion of the impeller.

11. The pump of claim 8 wherein the at least one flow-inducing protrusion extends outwardly away from the interior space of the impeller and extends from adjacent a first end portion of the impeller.

12. The pump of claim 8 wherein:

the fluid flow passage of the at least one flow-inducing protrusion extends along only a central portion thereof to thereby define a plurality of fluid flow stages of the impeller;

a first one of the fluid flow stages is located between the first end portion of the impeller and a first end portion of the fluid flow passage to impart a siphoning force onto fluid surrounding the impeller relative to the interior space of the impeller;

a second one of the fluid flow stages is located between the first end portion of the fluid flow passage and a second end portion thereof to draw at least a portion of the fluid surrounding the impeller into the interior space of the impeller at the second fluid flow stage; and a third one of the fluid flow stages is located between the second end portion of the fluid flow passage and the second end portion of the impeller to impart a flow profile onto the fluid within the interior space of the impeller.

13. The pump of claim 8 wherein each flow-inducing protrusion defines a cavity within an interior surface of the sidewall.

14. The pump of claim 13 wherein:

the at least one flow amplifying vane is a plurality of flow amplifying vanes; and each of the flow amplifying vanes has a cupped surface on a downstream facing side thereof.

15. The pump of claim 8 wherein:

the inlet of the flow amplification body is at an upstream end portion of the flow amplification body;

the outlet of the impeller is at a downstream end portion of the impeller; and the flow amplification body is directly attached to the impeller.

16. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, wherein a closed end portion of the interior space of the impeller opposite the downstream end portion thereof has a maximum inside diameter less than a maximum inside diameter of the interior space of the impeller at the downstream end portion thereof, and wherein the interior space of the impeller at the downstream end portion thereof has a maximum inside diameter the same as a maximum inside diameter of the central passage of the flow amplification body.

17. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, wherein the at least one flow amplifying vane is a plurality of flow amplifying vanes; wherein each of the flow amplifying vanes has a cupped surface on a downstream facing side thereof, wherein a closed end portion of the interior space of the impeller opposite the downstream end portion thereof has a maximum inside diameter less than a maximum inside diameter of the interior space of the impeller at the downstream end portion thereof, and wherein the interior space of the impeller at the downstream end portion thereof has a maximum inside diameter the same as a maximum inside diameter of the central passage of the flow amplification body.

18. The pump of claim 17 wherein:

the inlet of the flow amplification body is at an upstream end portion of the flow amplification body;

the outlet of the impeller is at a downstream end portion of the impeller;

the flow amplification body is directly attached to the impeller;

the at least one flow-inducing protrusion has a leading edge and a trailing edge; and the fluid flow passage of the at least one flow-inducing protrusion extends therethrough at the leading edge thereof.

19. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, wherein the at least one flow amplifying vane is a plurality of flow amplifying vanes, wherein the interior space of the impeller is exposed to the central passage of the flow amplification body, wherein a closed end portion of the interior space of the impeller opposite the downstream end portion thereof has a maximum inside diameter less than a maximum inside diameter of the interior space of the impeller at the downstream end portion thereof, and wherein the interior space of the impeller at the downstream end portion thereof has a maximum inside diameter the same as a maximum inside diameter of the central passage of the flow amplification body.

20. The pump of claim 19 wherein each of the flow amplifying vanes extends contiguously along an entire length of the interior surface of the flow amplification body.

21. The pump of claim 20 wherein each of the flow amplifying vanes has a cupped surface on a downstream facing side thereof.

22. The pump of claim 19 wherein:

the inlet of the flow amplification body is at an upstream end portion of the flow amplification body;

the outlet of the impeller is at a downstream end portion of the impeller; and the flow amplification body is directly attached to the impeller.

23. The pump of claim 19 wherein at least one of:

each of the flow amplifying vanes has a cupped surface on a downstream facing side thereof; and the at least one flow-inducing protrusion extends outwardly away from the interior space of the impeller and extends from adjacent a first end portion of the impeller.

24. A pump, comprising:

a rotor comprising an impeller and a flow amplification body, wherein an inlet of the flow amplification body is in fluid communication with an outlet of the impeller, wherein a central passage of the flow amplification body includes at least one flow amplifying vane therein, wherein the impeller includes a sidewall at least partially defining an interior space of the impeller, wherein the sidewall includes at least one flow-inducing protrusion extending outwardly therefrom, wherein the at least one flow-inducing protrusion has a fluid flow passage extending therethrough, wherein at least one of the at least one flow amplifying vane has a cupped surface on a downstream facing side thereof and the at least one flow-inducing protrusion extends outwardly away from the interior space of the impeller and extends from adjacent a first end portion of the impeller, wherein a closed end portion of the interior space of the impeller opposite the downstream end portion thereof has a maximum inside diameter less than a maximum inside diameter of the interior space of the impeller at the downstream end portion thereof and wherein the interior space of the impeller at the downstream end portion thereof has a maximum inside diameter the same as a maximum inside diameter of the central passage of the flow amplification body.

25. The pump of claim 24 wherein:

the inlet of the flow amplification body is at an upstream end portion of the flow amplification body;

the outlet of the impeller is at a downstream end portion of the impeller; and the flow amplification body is directly attached to the impeller.

* * * * *